United States Patent [19]

Caillet

[11] Patent Number: 4,655,004

[45] Date of Patent: Apr. 7, 1987

[54] DEVICE FOR AUTOMATICALLY LOCKING A HATCHWAY PANEL IN THE OPEN OR CLOSED POSITION

[75] Inventor: René Caillet, Saint Germain en Laye, France

[73] Assignee: Kone Oy, Helsinki, Finland

[21] Appl. No.: 769,643

[22] Filed: Aug. 27, 1985

[30] Foreign Application Priority Data

Jun. 25, 1982 [FR] France ..... 82 11226

[51] Int. Cl.[4] ..... E05F 15/00

[52] U.S. Cl. ..... 49/280; 160/188

[58] Field of Search ..... 49/279, 280, 293, 356; 160/188

[56] References Cited

U.S. PATENT DOCUMENTS 2,538,980 1/1951 Payne, Jr. ..... 49/280

3,272,552 9/1966 Park ..... 49/280 X R 3,860,288 1/1975 Martin et al. ..... 49/280 X R

FOREIGN PATENT DOCUMENTS 848173 9/1952 Fed. Rep. of Germany ..... 49/280

*Primary Examiner*—Kenneth Downey

*Attorney, Agent, or Firm*—William A. Drucker

[57] ABSTRACT

One element of the hatchway panel is hinged to the hatch coaming through a link and is connected to the piston rod of a hydraulic actuator of which the cylinder foot portion comprises a transverse pin adapted to slide within an elongate hole provided in a fixed support. On this fixed support is pivoted a locking hook adapted to co-act with a lateral stop of the panel for locking the panel in its closed position. When the hydraulic actuator is actuated for opening the panel, the foot portion of the actuator cylinder first engages a heel portion of the locking hook and causes this hook to pivot for automatically unlocking the panel.

6 Claims, 13 Drawing Figures

DEVICE FOR AUTOMATICALLY LOCKING A HATCHWAY PANEL IN THE OPEN OR CLOSED POSITION

BACKGROUND OF THE INVENTION

1. Field of the Invention

The invention relates to the automatic locking of a hatchway panel in the open or closed position.

2. Description of the Prior Art

In French Pat. No. 2 495 565, a device is proposed for automatically locking a hatchway panel in the open or closed position by a short travel actuator imparting to the panel a practically horizontal locking or unlocking movement by means of an irreversible mechanism separate from the operating mechanism which may comprise an actuator for driving either a hinged panel formed from one or two elements, or a panel which rolls transversely when it is a question of a panel which is not operated by lifting means such as cranes.

In the above case of a hatchway panel actuated by a driving actuator, the present invention has as its aim to provide automatic locking either in the closed position or in the open position, or else in both positions by means of the driving actuator, thus doing away with the auxiliary short travel actuator.

SUMMARY OF THE INVENTION

With the driving actuator placed between a fixed support and a shaft integral with the panel to be driven or with an element of this panel, the principle of the present invention consists in providing, between one end of the driving actuator and the part to which this end is connected, a moving means irreversibly actuated by the driving actuator at one end of travel so as to produce the desired automatic locking and unlocking without requiring the use of auxiliary actuators.

The invention is particularly applicable to a panel formed from a single pivoting element or from two elements, these panels being driven by a control actuator for opening and closing thereof.

The moving means actuated at one end of travel of the control actuator may be simple guiding of the actuator end to impart a small movement thereto with respect to the structure to which it is connected, this guiding being possibly provided, for example, by an ovalized hole formed at one end of the actuator for receiving the fastening pin of this actuator end so that, at one end of the travel of the actuator, the body of this actuator may move along its axis to control a locking mechanism.

The means for moving one actuator end in accordance with the invention may also be a short link interposed between this end and the structure to which it is connected, so that the movement of the link, at one end of travel of the actuator, ensures operation of the locking mechanism.

The moving means may be further in the form of a toggle joint to which is fastened one end of the actuator and which itself forms the irreversible locking mechanism because of the aligned arrangement of the two ends of the toggle joint at the end of the travel of the actuator which provides the desired automatic locking.

BRIEF DESCRIPTION OF THE DRAWINGS

For a better understanding of the invention a few embodiments will be described hereafter with reference to the accompanying drawings in which.

DESCRIPTION OF THE PREFERRED EMBODIMENTS

Figure 1:
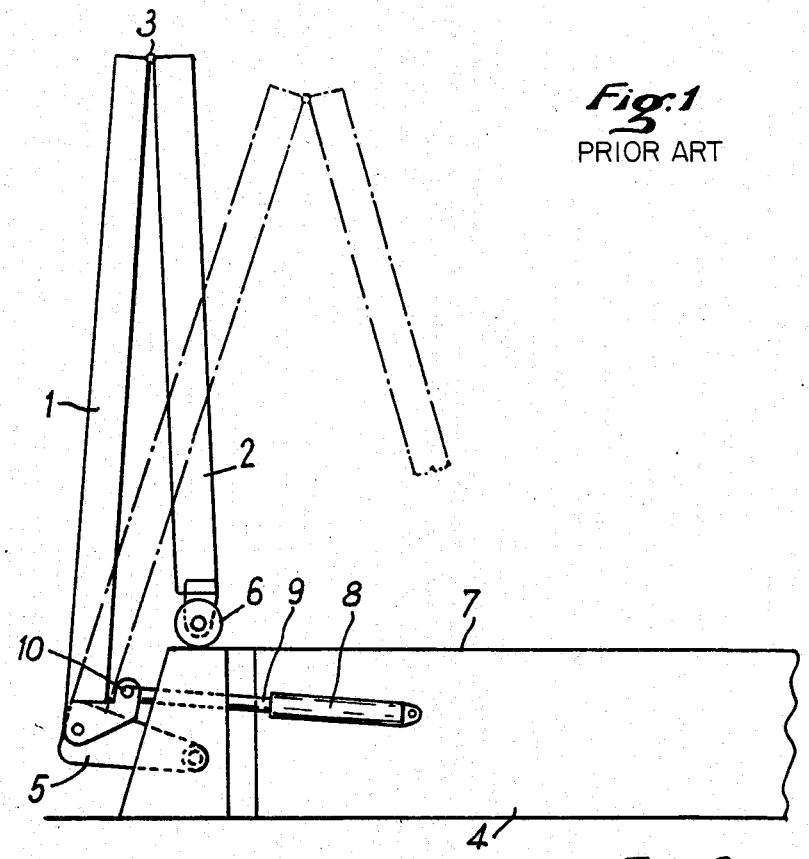
Fig. 1 PRIOR ART
FIG. 1 is a side elevational view showing schematically as prior art the general open and closed positions of a hinged hatchway panel made from two elements.
Figure 2:
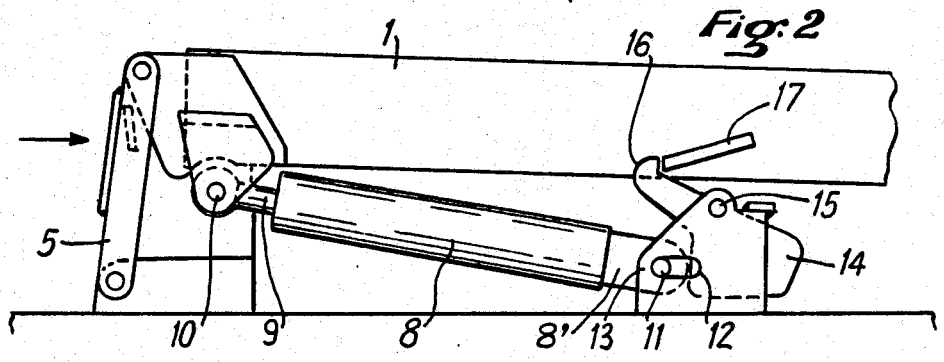
FIG. 2 is a partial view of a first form of embodiment of the invention showing the part of a panel comprising the control actuator in the closed position with a locking device controlled by this actuator.
Figure 3:
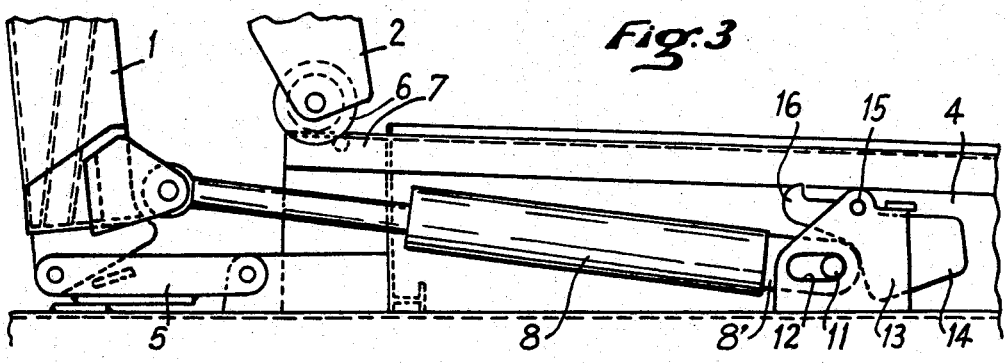
FIG. 3 is a partial view similar to FIG. 2 but corresponding to a partially or completely open position of the panel.

According to the prior art shown schematically in FIG. 1, the hatchway is closed by means of a panel made from two elements 1-2 hinged together about a shaft 3 and intended to be applied to the hatch coaming 4 in the closed position. In this example, element 1 is hinged to the hatch coaming by means of links 5 whereas element 2 carries, at its end opposite shaft 3, rollers 6 for rolling on lateral running tracks 7 provided on the sides of the hatch coaming 4. Control of panel 1-2 is provided by the action of an actuator 8, consisting of a well known cylinder and piston unit which comprises a cylinder within which a piston rod is hydraulically caused to slide. The head 9 of the piston rod is hinged to element 1 by a shaft 10. In accordance with a first embodiment of the present invention, FIGS. 2 and 3 show a locking in the closed position provided by a means for moving the foot of the actuator with respect to the support structure integral with the hatch coaming, this moving means consisting essentially in the cooperation of a hinge shaft and an elongate hole through which this shaft passes. In this first embodiment, the actuator foot 8' carries a hinge pin 11 guided in horizontally elongate holes 12 of a support member 13 integral with the hatch coaming 4 so that this foot of the actuator may undergo a small horizontal movement for acting on the heel of a locking hook 14 movable about a horizontal pin 15. In the closed position, the body and the foot of the actuator 8 are in their left-hand position, shown in FIG. 2, allowing the heel of hook 14 to advance leftwards and consequently the nose 16 of the hook to be raised at the level of a lateral stop 17 of the panel element 1, the hook being returned to this locking position by any suitable means (not shown).

Since opening is effected by extension of the actuator to the position shown in FIG. 3, it will be readily understood that the initial opening action which tends to push the head 9 of the piston rod leftwards results in causing the foot of the actuator to move to the right, thus pushing back the heel of hook 14 and consequently lowering the nose 16 of the hook, so that the initial movement of panel element 1 towards the left in FIGS. 2 and 3 is made possible after unlocking resulting from the lowering of nose 16.

Figure 4:
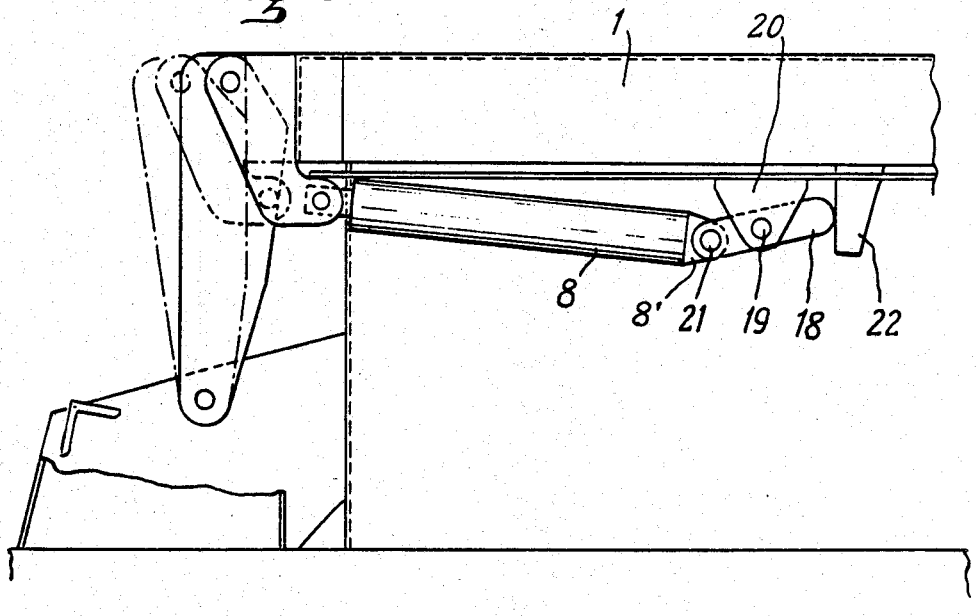
FIG. 4 is a partial view of a second embodiment showing in its closed position the control end of a hinged panel element, with the control actuator and a locking control link interposed between the foot of the actuator and the support structure.
Figure 5:
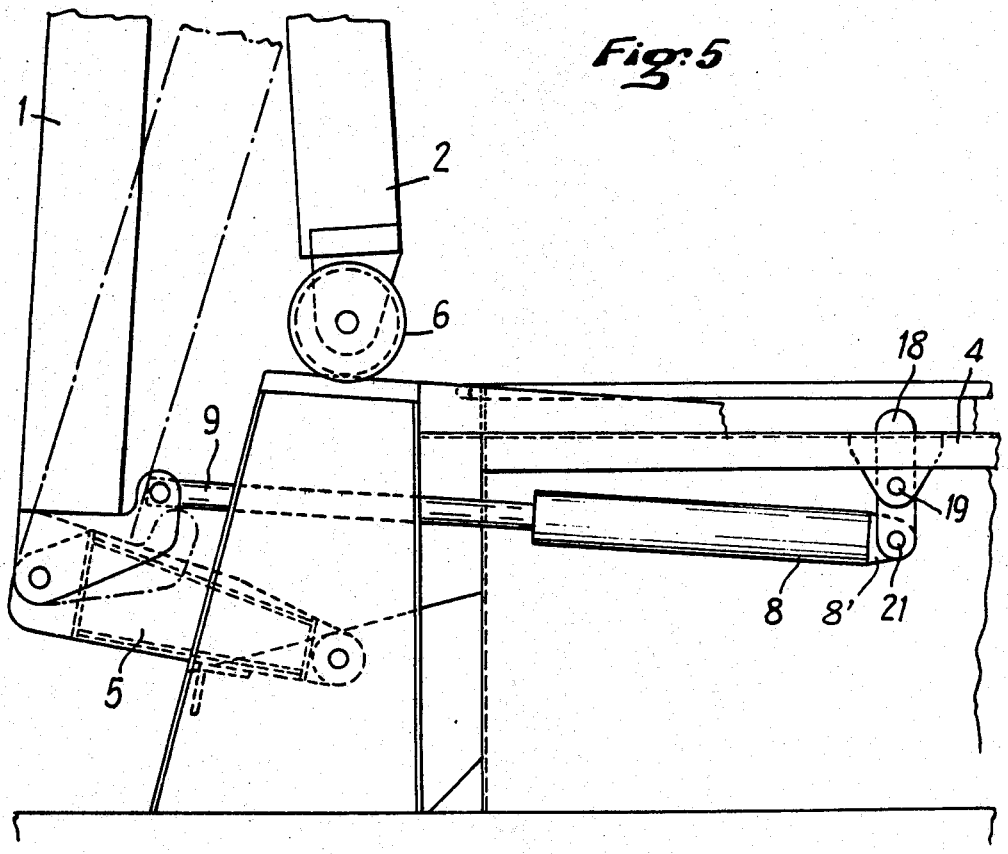
FIG. 5 is a view corresponding to FIG. 4 but showing the panel in its open position.

FIG. 4 shows another embodiment with a means for moving the foot of actuator 8 equivalent to the one shown in FIGS. 2 and 3 and formed by a link 18 pivoting about a median pin 19 on a fixed support 20 and mounted by one end to the foot 8' of the actuator 8 for pivoting about a pin 21, whereas the opposite end of link 18 pivots in front of a stop 22 of panel element 1. In the locked closed position shown, panel element 1 cannot move leftwards because stop 22 is held back by link 18 whose position is established to guarantee the irreversibility of the pivoting movement of the link which is almost horizontal in the locked position. It will be readily understood that, at the beginning of the opening control, the foot 8' of actuator 8 tends to move to the right while causing link 18 to pivot in an anti-clockwise direction. The movement of this link may begin because of a suitable orientation of the actuator in the locked closure position, the angle between the axis of the actuator and the longitudinal axis of the link being greater than the angle formed by this link axis with the horizontal. Thus, the link may be moved away from its locked position by the action of the actuator but not by the action of the panel, which provides the desired irreversibility. FIG. 5 shows the device of FIG. 4 in the open position of the panel elements.

Figure 6:
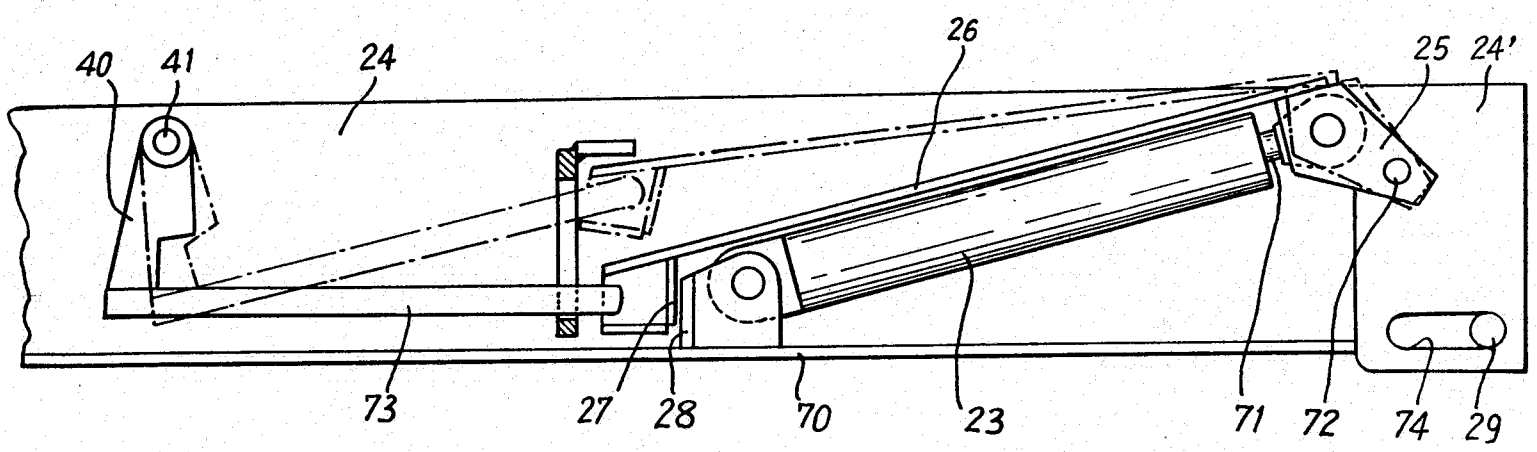
FIG. 6 shows a third embodiment in which the head of the control actuator acts through a control lever which, at the beginning of opening, raises a locking bracket for providing unlocking.

Referring now to FIG. 6, there is shown another embodiment of the device according to the invention. On the coaming 70 lies the panel 24 in its horizontal closed position. A control actuator has its cylinder 23 pivoted to a strap 28 while the free end of its piston rod 71 is fastened to the panel 24 by means of a small lever 25, pivoted at 72 to an end 24' of panel 24 and which carries a locking bracket 26 whose end 27 can take up a closure position behind the strap 28 constituting a fixed stop. The end 27 of locking bracket 26 comprises a hollow portion into which is engaged the end of a rod 73 which is rigid with a bracket 40 pivoted at 41 to the panel 24. As can be seen in full lines in FIG. 6, the panel is in its fully closed position and is locked in this position by the disposition of the end 27 of the locking bracket 26 behind the fixed strap 28.

At the beginning of the opening operation, the beginning of the extension of the piston rod 71 causes lever 25 to pivot in the clockwise direction to the position shown in chain-dotted lines at FIG. 6, and consequently causing locking bracket 26 to pivot and free its end 27 from the strap 28. The extension of the piston rod thus allows the small initial horizontal movement of panel 24 before this panel pivots about a fixed shaft 29 which passes through a horizontally elongate opening 74 in the end 24' of panel 24.

Figure 7:
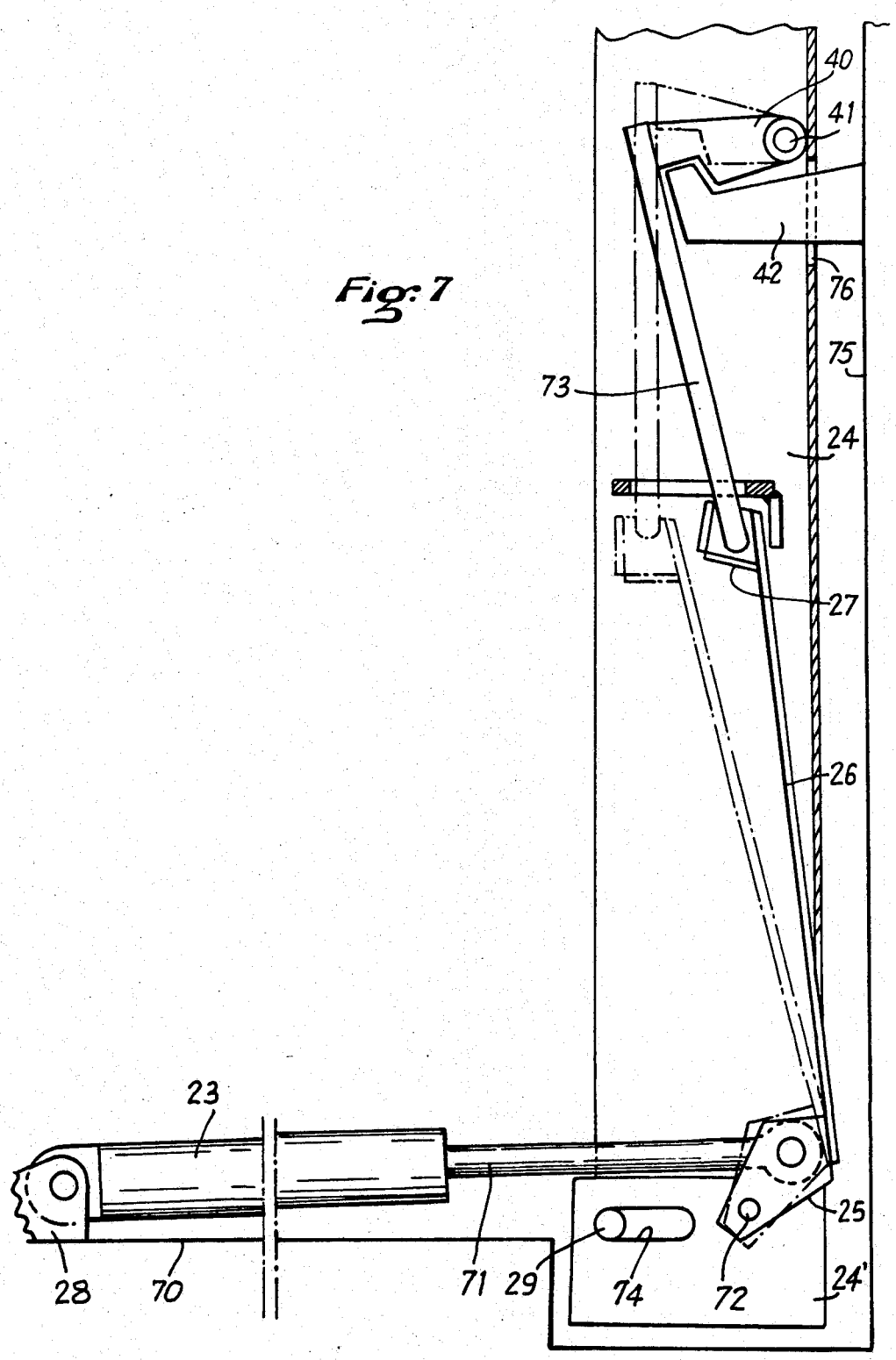
FIG. 7 shows the device of FIG. 6 in the open position with the panel element locked in its open position.

At FIG. 7 there is shown the device of FIG. 6 with the panel 24 in its vertical open position. The locking of panel 24 in its open position is obtained by engagement of a hook 42 carried by a fixed vertical wall 75 and passing through an opening 76 of panel 24 by the bracket 40 pivoted at 41 to panel 24. When it is desired to close the panel 24, rectraction of piston rod 71 first causes lever 25 to pivot in the counter-clockwise direction (to the position shown in chain-dotted lines) that causes bracket 40 to pivot in the counter-clockwise direction, disengaging hook 42 and allowing panel 24 to close by pivoting about shaft 29.

Figure 8:
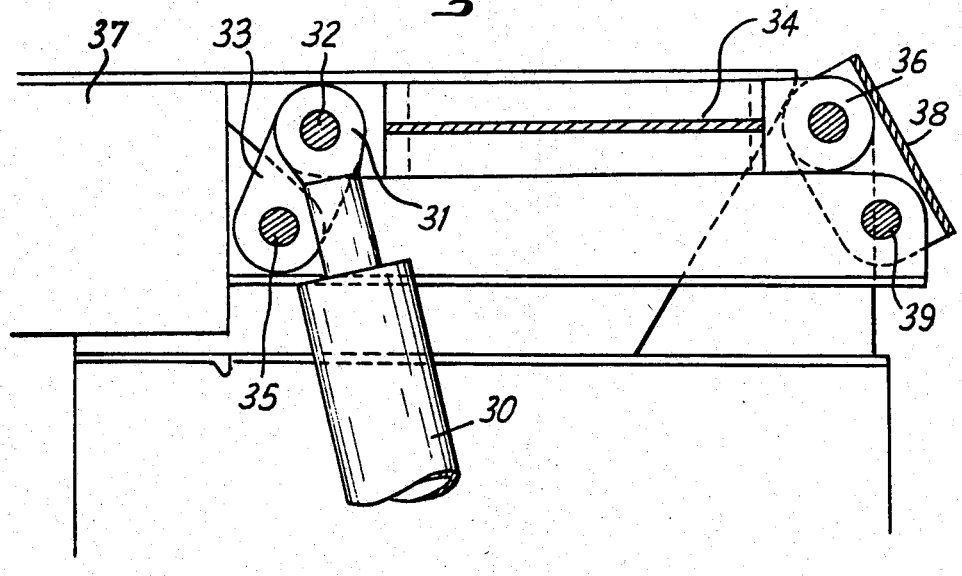
FIG. 8 shows another form of embodiment with a locking device in the closed position formed by a toggle joint actuated by the head of a control actuator, this toggle joint providing, at the same time, locking in the open position.
Figure 9:
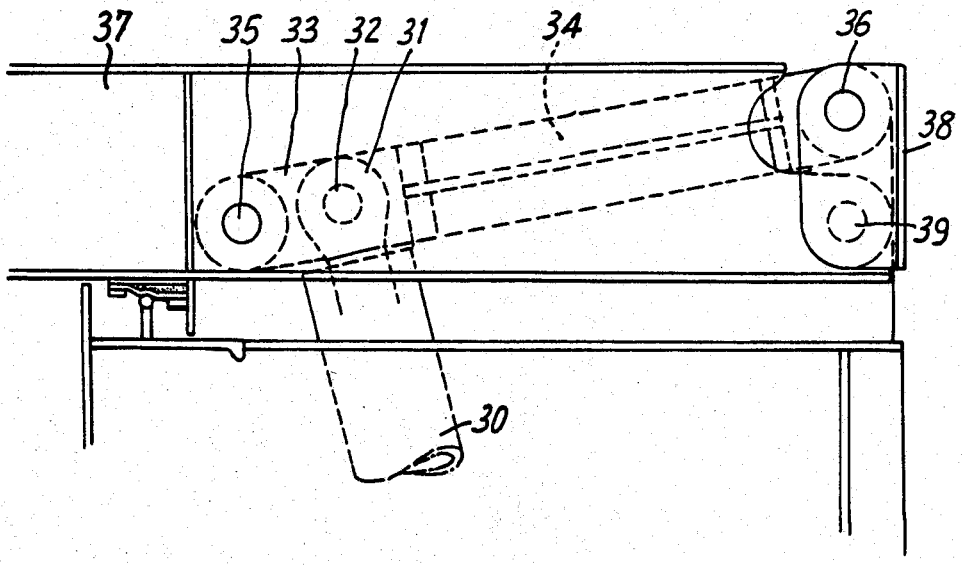
FIG. 9 shows the action of the toggle joint of FIG. 8 in the closed position.

According to another embodiment, the moving means provided between one end of the actuator and the associated structure, for example the panel or the element of the panel fastened to the control actuator, may be formed by a toggle joint as is shown in FIGS. 8 and 9 in which the actuator has been shown at 30. The head 31 of the piston rod of this actuator acts on pin 32 of the toggle joint formed of two arms 33–35 whose ends 35–36 are pivotably mounted respectively to panel element 37 and to a link 38 pivoting about the fixed shaft 39. FIG. 8 shows the position of the unlocked toggle joint before the end of closure or the beginning of opening, whereas FIG. 9 shows the locking position, the panel element passing from one of the two positions to the other by a small horizontal movement. It will be understood that in the locking position (FIG. 9) the alignment of the toggle joint provides the desired irreversibility which ensures that the panel is held in position whatever the forces applied thereto. On the contrary, extension of the actuator for opening causes the toggle joint to bend as shown in FIG. 8 while causing initially a small movement limited by the arrangement of the link.

Figure 10:
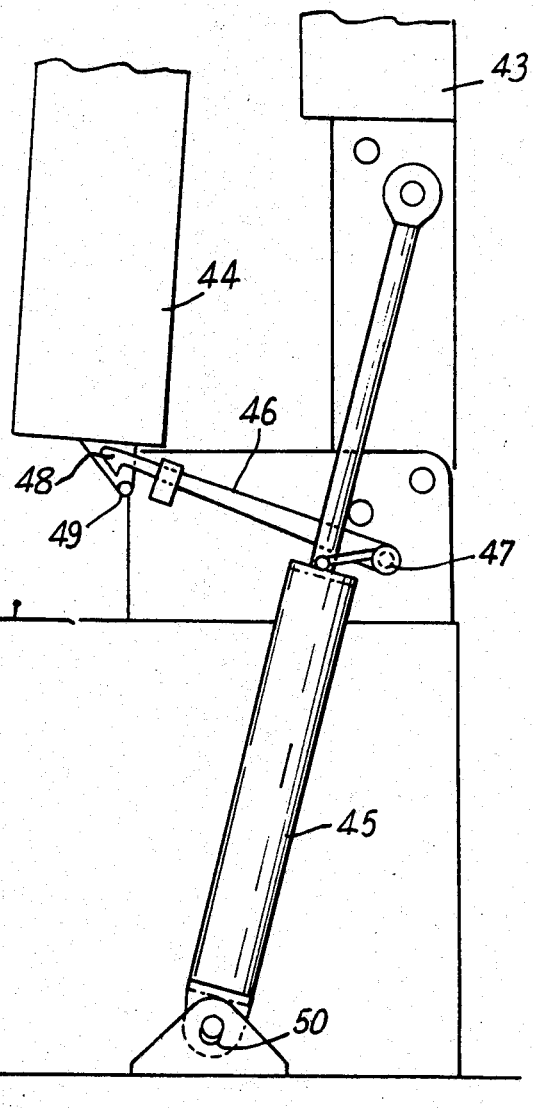
FIG. 10 is a diagram showing another form of embodiment of the locking device in the open position actuated for unlocking by the control actuator at the beginning of closure.

According to another embodiment, FIG. 10 shows schematically the locking of a hinged panel formed from two elements 43–44 of which the figure only shows the lower ends, the panel being shown in the open position. In this example, foot 50 of the control actuator 45 is ovalized so that at the beginning of the closure order it is raised following the pull exerted on the head of the actuator and this raising allows the body of the actuator to raise hook 46, pivoting about the fixed pin 47 so that the nose 48 of this hook is freed from the previously locked pin 49.

Figure 11:
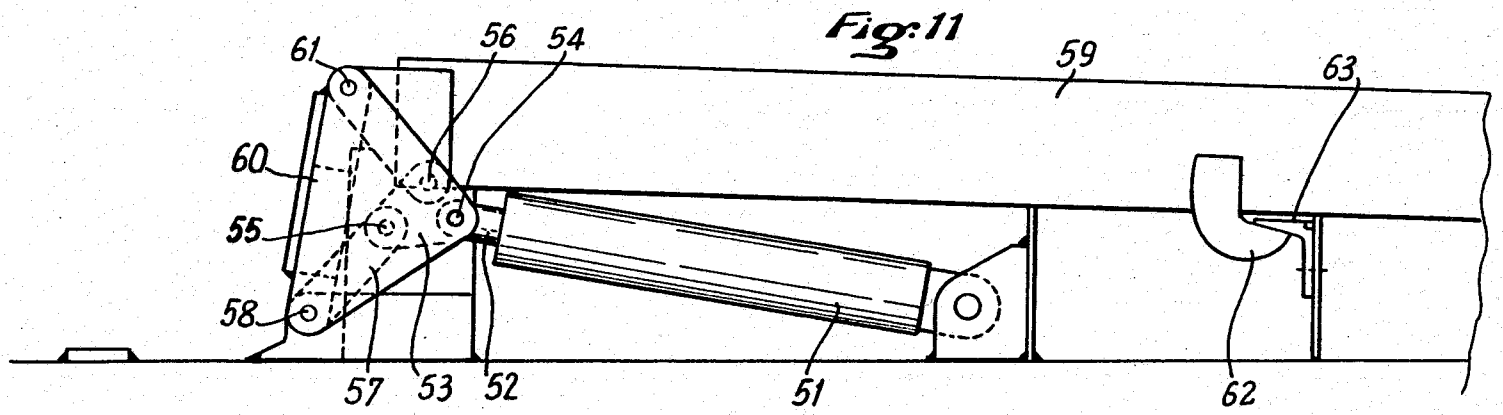
FIG. 11 shows a further embodiment which ensures locking in the closed position by means of a toggle joint device also allowing locking in the open position.

According to a further embodiment of the invention, it is possible to establish, between the head of the piston rod of the control actuator and the panel element fastened to the actuator, a toggle joint device allowing locking to be provided both in the closed position and in the open position of the panel and such a double-acting locking device has been shown schematically in FIGS. 11 to 13 to which reference will now be made.

There is shown at 51 the control actuator whose rod 52 is fastened to a part 53 with three pins 54-55-56 for connecting this part 53 respectively with rod 52, with link 57 pivoting about the fixed pin 58 and with the panel element 59 driven by the actuator 51. A link 60 is further pivotably mounted on the fixed pin 58 and on a pin 61 integral with the panel element 59.

In the closure position (FIGS. 11 and 12), link 60 is raised in a position close to the vertical whereas the panel element 59 occupies a horizontal position. In the locked closure position (FIG. 11), the panel element 59 has been pushed to its endmost right-hand position with engagement of its latch 62 under the hook 63 integral with the hatch coaming and it will be noted that in this position pin 55 of part 53 is practically in alignment between the two pins 56 and 58 while forming the pin of a toggle joint provided between these two pins 56 and 58. This toggle joint makes the movement of its two elements 53–57 irreversible, so that it can only bend again by the advance of the actuator rod 52 (FIG. 12) required for providing unlocking at the beginning of opening with a practically horizontal movement from right to left of the panel element 59.

Figure 12:
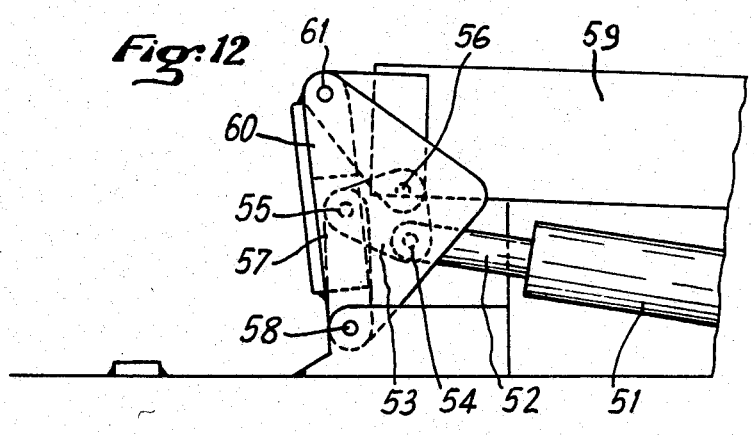
FIG. 12 shows the device of FIG. 11 in the unlocking position at the beginning of opening.
Figure 13:
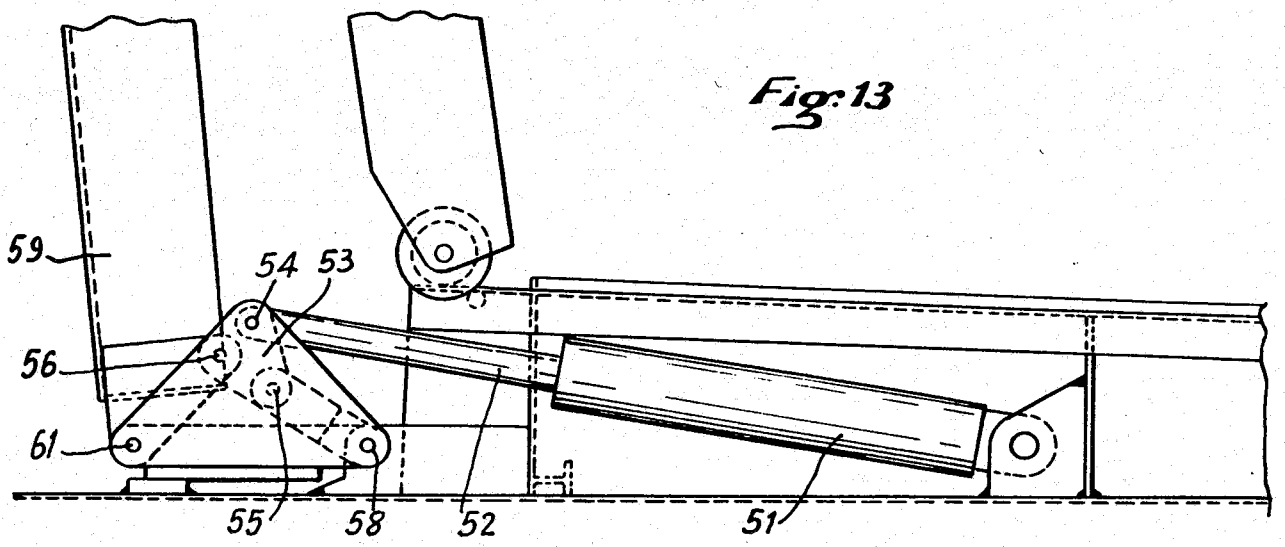
FIG. 13 shows the same device in the open and locked position.

If the extension of the actuator continues from this position of FIG. 12, pin 61 continues to be pushed back leftwards while pivoting as a consequence about the fixed pin 58 to the final open position shown in FIG. 13 in which pins 54-56-61 on the one hand and 58-55-56 on the other are practically in alignment, which ensures locking in the open position whereas unlocking at the beginning of closure results from the actuator rod 52 beginning to move back, which causes bending of the toggle joint 58-55-56.

It can be seen from the preceding description that the head of the piston rod of the control actuator 51, i.e. its rod 52, is pivotably mounted on a part 53 which carries moreover the pins of two toggle joints 55–56 providing respectively locking in the closed position and in the open position.

What I claim is:

1. A device for automatically locking a hatchway panel in the open or closed position, comprising:

(a) a control actuator consisting of a cylinder and piston unit disposed between a fixed support and a panel element for moving said panel from a closed position to an open position or inversely, (b) an automatic locking mechanism for the panel, said mechanism comprising a pivoted locking element movable between an operative locking position in which it registers with a portion of a panel element and prevents displacement of the panel and an inoperative unlocked position in which said panel is free to move, and (c) connecting means between said control actuator and said fixed support, said connecting means comprising a transverse axis rigid with the bottom of the cylinder of the control acuator and an ovalized hole provided in the fixed support and within which said transverse axis is adapted to slide, said bottom of the actuator cylinder being disposed in the vicinity of a portion of the locking element so that, at the beginning of the actuation of the control actuator for opening the panel, the actuator cylinder moves in said ovalized hole to engage said locking element and rock same to an unlocked position.

2. A device for automatically locking a hatchway panel in the open or closed position, comprising:

(a) a control actuator consisting of a cylinder and piston unit disposed between a fixed support and a panel element for moving said panel from a closed position to an open position or inversely, (b) an automatic locking mechanism for the panel, said mechanism comprising a pivoted locking element movable between an operative locking position in which it registers with a portion of a panel element and prevents displacement of the panel and an inoperative unlocked position in which said panel is free to move, and (c) connecting means between said control actuator and said fixed support, said connecting means comprising a transverse axis rigid with said fixed support and an ovalized hole provided in the bottom of the cylinder of the control actuator and within which said transverse axis is adapted to slide, the portion of said cylinder opposed to the cylinder bottom being disposed in the vicinity of a portion of the locking element so that, at the beginning of the actuation of the control actuator for the closing of the panel, the actuator cylinder moves with relation to the fixed support to engage said locking element and rock same to an unlocked position.

3. A device for automatically locking a hatchway panel in the open or closed position, comprising:

(a) a control actuator having a piston rod disposed between a fixed support and a panel element for moving said panel from a closed position to an open position and inversely, (b) a lever having one end pivoted to the panel and the other end pivoted to the free end of the piston rod of the control actuator, (c) a locking bracket rigid with said lever and adapted, in the fully retracted position of the piston rod corresponding to the closed position of the panel, to come behind said fixed support acting as a stop, the feeding of the control actuator causing first said lever to pivot in the direction removing said locking bracket from said fixed support.

4. A device for automatically locking a hatchway panel in the open or closed position, comprising:

(a) a control actuator having a piston rod disposed between a fixed support and a panel element for moving said panel from a closed position to an open position and inversely, (b) a lever having one end pivoted to the panel and the other end pivoted to the free end of the piston rod of the control actuator, (c) a locking bracket rigid with said lever and adapted, in the fully retracted position of the piston rod corresponding to the closed position of the panel, to come behind said fixed support acting as a stop, the feeding of the control actuator causing first said lever to pivot in the direction removing said locking bracket from said fixed support, (d) said locking bracket coacting with a latch pivoted on a panel element for hooking on, in a fully open position of the panel, to a hook carried by a vertical wall at the end of the hatch coaming.

5. A device for automatically locking a hatchway panel in the open or closed position, comprising:

(a) a control actuator having piston rod disposed between a fixed support and a panel element for moving said panel from a closed position to an open position and inversely, (b) a first arm pivoted at one end to a panel element and at the other end to the free end of the piston rod sliding within said acuator, (c) a second arm pivoted at one end to said free end of the piston rod and at the other end to a link pivoted in turn around a fixed axis, said first and second arms being adapted, in a fully retracted position of the piston rod corresponding to the closed position of the panel, to come in an aligned arrangement locking the panel in the manner of a toggle joint.

6. A device for automatically locking a hatchway panel in the open or closed position, comprising:

(a) a control actuator having a piston rod disposed between a fixed support and a panel element for moving said panel from a closed position to an open position and inversely, (b) an automatic locking mechanism of the panel in its closed position, said mechanism comprising at least one lever pivoted between a free end of the piston rod of the control actuator and the panel, so that for the opening of the panel the actuation of the control actuator first causes said lever to pivot for unlocking said panel and for allowing said panel to open under the action of the actuator, said free end of the piston rod being pivoted to one angle of a triangular lever of which the other two angles are respectively connected through links to a fixed point and to the panel while a further link connects said panel to said fixed point, so that in the closed position of the panel the angle of the triangular lever connected to the panel comes in an aligned arrangement with the link connecting said triangular lever in the fixed point thus ensuring the locking of the panel in its closed position while, when the panel is in its open position, the angle of the triangular lever connected to the panel also comes in an aligned arrangement with the link connecting said triangular lever to the fixed point thus also ensuring the locking of the panel in its open position.

* * * * *